United States Patent [19]

Ludwig

[11] Patent Number: 4,844,492

[45] Date of Patent: Jul. 4, 1989

[54] TWO WHEELED ROLLER SKATE

[76] Inventor: Edward E. Ludwig, 40 Drake St., Yarmouthport, Mass. 02675

[21] Appl. No.: 174,138

[22] Filed: Mar. 28, 1988

Related U.S. Application Data

[63] Continuation-in-part of Ser. No. 835,373, Mar. 3, 1986, abandoned.

[51] Int. Cl.[4] ..... A63C 17/02

[52] U.S. Cl. ..... 280/11.23; 280/11.28; 301/5.7

[58] Field of Search ..... 280/11.19, 11.22, 11.23, 280/11.1 BR, 11.28, 11.1 BT, 11.25; 301/5.3, 5.7

[56] References Cited

U.S. PATENT DOCUMENTS

| | | | |
|---|---|---|---|
| 257,426 | 5/1882 | Witsil | 280/11.23 |
| 1,294,984 | 2/1919 | Ware | 280/11.19 |
| 2,095,942 | 10/1937 | Wetterstrand | D21/226 X |
| 3,180,651 | 4/1965 | Ware | 280/11.2 |
| 3,282,598 | 11/1966 | Goodwin | 280/11.22 |
| 3,355,185 | 11/1967 | Carter | 280/11.23 |
| 4,047,727 | 9/1977 | Holladay et al. | 280/11.28 X |
| 4,132,425 | 1/1979 | Lehner et al. | 280/11.23 |
| 4,294,456 | 10/1981 | Tuell et al. | 280/11.23 X |
| 4,373,736 | 2/1983 | Stumbaugh | 280/11.23 |

FOREIGN PATENT DOCUMENTS

| | | | |
|---|---|---|---|
| 1113168 | 8/1961 | Fed. Rep. of Germany | 280/11.1 R |
| 2938316 | 4/1981 | Fed. Rep. of Germany | 280/11.23 |
| 433586 | 4/1948 | Italy | 280/11.23 |
| 6241 | 1/1977 | Japan | 280/11.1 BR |
| 202577 | 4/1939 | Switzerland | 280/11.23 |

*Primary Examiner*—Charles A. Marmor
*Assistant Examiner*—Michael Mar
*Attorney, Agent, or Firm*—Barlow & Barlow

[57] ABSTRACT

A two wheel roller skate has a roller that has two distinct surfaces consisting of a central part that is a curved surface and matching right and left frusto conical sections that have an angle that equals the degree of arc in the central part measured from the central point of the central part's arc providing greatly improved maneuverability.

2 Claims, 1 Drawing Sheet

TWO WHEELED ROLLER SKATE

CROSS-REFERENCE TO RELATED APPLICATION

This appliction is a continuation in part of application Ser. No. 06/835,373 filed Mar. 3, 1986 now abandoned.

BACKGROUND OF THE INVENTION

This invention relates to the art of the two-wheel roller skate. A review of prior art literature discloses a long history of worldwide interest and effort in this subject dating from the earliest days of the roller skate industry and covering a wide range of skate designs and roller types. Yet, the two-wheel roller skate has never achieved true success, and the critical problem still remains, how to make this type of skate fully maneuverable and safe.

Maneuverability in a roller skate requires an efficient and reliable system for mechanical turning of the roller assemblies. This problem was solved in the case of four-wheel skates by the introduction of the double-action turning mechanism commonly used in all such skates today. It is a leverage-oriented system ideally suited to the nature of four-wheel skates where there are two cylindrical rollers in each roller assembly thus allowing an optimum degree of lateral roller stability for the skater to work with in generating the leverage force needed to operate the turning mechanism.

It is a different matter, however, in the case of two-wheel roller skates where there is only one roller per assembly thereby severely limiting the degree of lateral roller stability available to the skater in producing the necessary leverage force. If a conventional double-action turning mechanism is to be effectively employed in a two-wheel roller skate then it is necessary to provide a roller that can better address the needs for both lateral mobility and improved lateral stability in a single roller.

In the prior art of two-wheel roller skates, attempts have been made in the past to arrange a suitable wheel assembly, as for example, in the Holliday, et al U.S. Pat. No. 4,047,727, where there is provided a central roller wheel with a pair of frustoconical independent rotatable end portions. There are other disclosures in the art of frustoconical rollers, as for example in the Goodwin Pat. No. 3,282,598 where a single unitary roller construction is disclosed, the two conical sections of the roller abutting at the center in a defined V-shaped edge. Other examples are seen in Japanese Pat. No. 52,6241 to Morita which discloses a single roller of somewhat barrel shape having one continuous arcuate surface with recessed grooves therein.

SUMMARY OF THE INVENTION

It is an object of this invention to provide a two-wheel roller skate having improved rollers with increased lateral stability contributing directly to improved efficiency in the operation of the double-action turning mechanism and improved safety and control in turning maneuvers.

It is a further object of this invention to provide a general purpose two-wheel roller skate suitable for indoor and outdoor use on normal skating surfaces, that is practical in respect to manufacturing means and materials, that would be moderately priced, easy to operate and provides improved maneuverability.

This invention provides certain improvements in the mechanical efficiency, operation and performance ability of a two-wheel roller skate by the employment of improved rollers, based upon the use of improved dual-surfaced rollers having conically surfaced end parts providing increased lateral roller stability in combination with an arcuately surfaced central part providing lateral roller mobility.

The method of integrating the two distinct surfaces within a single roller configuration provides that the conically surfaced end parts extend from the respective bounds of the arcuately surfaced central section thus extending the angle of inclination occuring at said bounds throughout the lateral width of the conical end surfaces. The two distinct surfaces, thus integrated, provide a degree of ease in the lateral articulation between surfaces that is much improved over dual-surfaced rollers having a cylindrically surfaced central part or rollers with only opposing conical surfaces.

The arcuately surfaced central section of the roller provides for unimpeded mobility in lateral inclination throughout the range of radial curvature in said central section thus enabling the skater to shift his or her balance point, as need or desire dictates, to any point along the lateral width of the central section surface.

When the rollers are inclined, as in turning maneuvers, to where the right or left conically surfaced end parts engage the skating surface, the resulting extended conical surface contact restricts further inclination of the roller thereby providing increased lateral roller stability. This increased stability permits a proportionate increase in the application of lateral turning pressure by the skater to activate the turning mechanisms resulting in greater turning force and turning efficiency than is found in rollers having a continuous radially curved surface.

Of equal importance to maneuverability is the improved traction and control in turns resulting from the increased amount of frictional contact provided by the frusto-conical end parts. This improved traction, together with the angular orientation of the conical contact, permits the skater to lean into turns in a more natural skating style and provides substantially more turning control and safety than is evident in prior art two-wheel roller skates.

This arrangement provides the basis of the roller's surface design in this method of roller construction and also establishes the arcuately surfaced central part as the controlling element effecting surface configuration and related roller function. A decrease in the degrees of arc will cause a decrease in the angle of inclination of the end parts and result in increased roller stability and quicker turning response while producing less mobility on the central section of the roller. Increasing the degrees of arc reverses the equation. Small variations in this respect could find useful application in the design of specialized rollers for different age groups, skill levels and activities.

The improved roller essentially is particularly designed to engage a flat skating surface such as in a roller rink and provide improved lateral stability and improved turning maneuverability and traction.

DESCRIPTION OF THE PREFERRED EMBODIMENT

Figure 1:
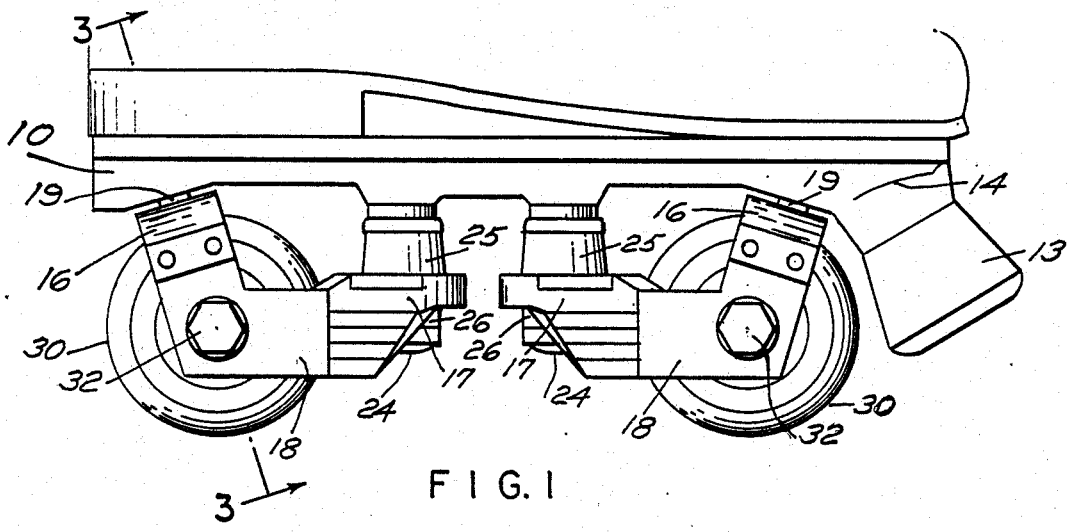
FIG. 1 is a side elevation of a roller skate constructed in accordance with the invention.
Figure 2:
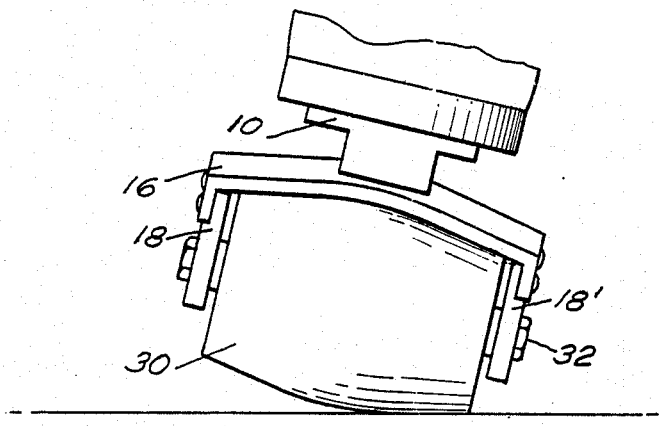
FIG. 2 is a rear elevation of the skate shown in an inclined position.
Figure 3:
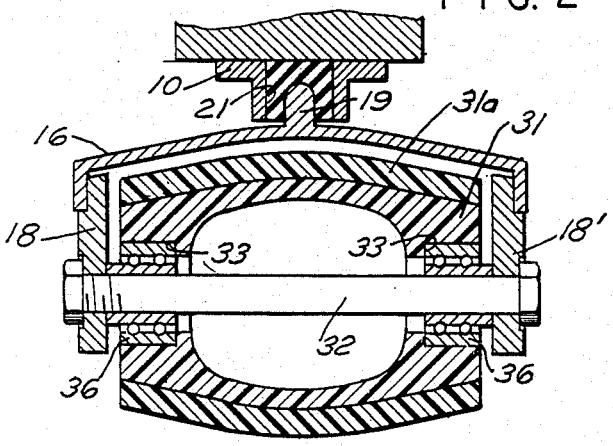
FIG. 3 is a sectional view of the hanger and roller assembly taken on lines 3—3 of FIG. 1.

With reference to FIG. 1, 10 illustrates a supporting plate of the roller skate which is fastened to footwear in any suitable manner (not shown). On the forward end of the supporting plate is a toe stop 13 that is attached to the supporting plate in any suitable manner as at 14. Attached to the supporting plate are a pair of rollers and for convenience only one roller structure will be described. Each roller has a hanger 16 from which depends, by suitable fastenings, a pair of brackets 18, 18', that are illustrated as being made from plastic material for weight considerations. As will be appreciated the hanger 16 and the brackets 18, 18' may be formed as a unit out of a single piece of material. The brackets have an integral arm 17 that leads away from the main body of the brackets. On the hanger 16 is a pivot post 19 which is adapted for insertion into a pivot post socket such as 21 (see FIG. 3) on the supporting plate 10 with a resilient cushion 19a. The arm 17 is provided with an aperture therein that receives a bolt 24, the bolt 24 having a tapered cushion 25 thereon, which cushion is made in two parts, there being also a lower part 26. The arrangement is such, as well known to those skilled in the art, that the arm 17 is essentially supported by the resilient cushions and with the pivot post 19 also supporting the hanger, the two cooperate so that angular displacement of the roller assembly may be had.

Figure 4:
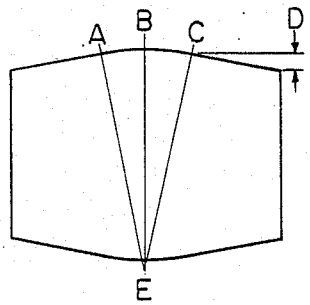
FIG. 4 is a diagramatic view showing the development of the surface of the roller.

Mounted on the hanger 16 by an axle bolt 32 is the roller 30 of the instant invention. The roller is constructed of two parts, there being an internal part in the form of a rigid core element 31 provided with recesses 33 at the ends thereof into which anti-friction bearings 36 may be received. The outer surface 31a of the roller is polyurethane for good wearing ability and is cast about the core element. As seen in FIG. 4 of the drawings, the roller that is there illustrated employs a circular arc A–C of 22 degrees and has a 2.68 inch radius; thus, when this is combined with a roller that has a maximum diameter of 2.5 inches and the lateral width of approximately 3.125 inch, the central arc portion subtends a lateral width of approximately 1.0 inch. In the example given, the chord of arc AC equals 1 inch and the surface of the conic section equals 1.06 inch. Essentially, there is an arcuately surfaced central part with conically surfaced end parts and the conical end parts have their surfaces defined to the central axis at an angle that is equal to the angle of the arc A-B, thus, arc A-B equals angle D and arc B-C equals angle D.

The shape of the central section, which has essentially a symmetrical arcuate surface, provides a running surface on the central part of the roller that gives an ease of side-to-side rolling movement on a flat ground surface such as on a roller skating rink. The running surface of the end parts, which are conically tapered, provide a resistance to the degree of inclination of the roller on the flat ground surface, and thereby provides greater stability in turns, and, in addition, provides a leverage potential that facilitates right and left turns.

Stated another way, the surface of the central arcuately surfaced section provides for skating motion in a general forward direction and provides mobility in right and left hand lateral inclinations. This allows the skater to shift his balance point on the rollers to any point along the lateral width of the central part thus, easily accomodating changes in posture and attitude contributing to flexibility in skating style. The frusto-conical surfaces provide the skater with improved lateral stability and with a more stable roller surface to work with when applying lateral pressure to the right or left end parts of the rollers. Also the hanger itself is a lever, more precisely a two sided lever with a double action turning mechanism centrally mounted thereon. Thus, the hanger with the roller constitutes a combined roller hanger means for converting the skater's lateral pressure into leverage forces.

The improved mechanical efficiency described above is responsible for improved operation of the double action turning mechanism and consequently, improved turning maneuverability. The improved operation of the double action turning mechanism is proportionate to the controlled application of lateral pressure by the skater on the right or left conically tapered end parts of the rollers in the execution of right or left turns respectively. An additional major benefit of the conically tapered end parts of the rollers is the improved traction and control they provide in turns due to the increased lateral contact of the rollers with the skating surface when the rollers are fully inclined in turning maneuvers which contributes to a safer, more reliable two wheel roller skate.

I claim:

1. A roller skating device comprising in combination a supporting plate for engagement to footwear of a skater and a pair of longitudinally spaced roller wheel assemblies, each wheel assembly comprising a hanger having a roller-supporting forked bracket extending from the plate, resilient mounting means for pivotally securing each hanger to said supporting plate, and a roller rotatably secured to said forked bracket, each roller having a central section with a transversely curved surface and a frusto-conical end section of decreasing diameter extending from each side of said central section, the combined length of said central section and said end sections being substantially greater than the largest diameter of said central section, wherein the angle of taper, as measured from a line extending parallel to the axis of the roller, of each end section is equal to one half of the arc of curvature of said central section and is also equal to the angle of inclination occurring at the outer boundary of said central section.

2. A roller skating device as in claim 1 wherein the arc of curvature is substantially equal to 22 degrees and the frusto-conical sections have an angle of taper of substantially 11 degrees from the central section.

* * * * *